United States Patent [19]

Tronstad

[11] 4,030,475

[45] June 21, 1977

[54] FIREPLACE

[75] Inventor: Knut Tronstad, Oslo, Norway

[73] Assignee: Aksjeselskapet Jotul, Oslo, Norway

[22] Filed: Oct. 8, 1975

[21] Appl. No.: 620,710

[30] Foreign Application Priority Data

Dec. 4, 1974 Norway ..... 744381

[52] U.S. Cl. ..... 126/121; 49/40; 49/41; 126/140; 126/202

[51] Int. Cl.[2] ..... F24B 7/00

[58] Field of Search ..... 126/140, 202, 120, 121; 49/40, 41

[56] References Cited

UNITED STATES PATENTS

| | | | |
|---|---|---|---|
| 1,588,587 | 6/1926 | Klaus | 126/121 |
| 2,864,133 | 12/1958 | Younger | 49/40 |

FOREIGN PATENTS OR APPLICATIONS

| | | | |
|---|---|---|---|
| 667,570 | 3/1952 | United Kingdom | 126/202 |

*Primary Examiner*—Ronald C. Capossela
*Attorney, Agent, or Firm*—Finnegan, Henderson, Farabow & Garrett

[57] ABSTRACT

A fireplace or fireplace insert is provided with semicircular rooms or channels for storage of a guided door and/or fire-screen which are/is movable from a position in front of the fireplace to a storage position in said rooms or channels.

6 Claims, 2 Drawing Figures

FIREPLACE

The present invention relates to an improvement in a fireplace, particularly fireplace inserts to be built in, in a great variety of designs of masonry fireplaces.

It has previously been well known and a great advantage to use pre-fabricated cast-iron inserts when building fireplaces, as one is then assured of obtaining the correct draught and combustion conditions. Furthermore, free-standing, prefabricated fireplaces are known, with hinged doors and fire-screens, which when desired, can be swung up in front of the fireplace opening when necessary.

It has been desirable for some time to have guided doors and fire-screens which have a predetermined movement and storage space for fireplace inserts as well which are intended to be built in on the spot.

As production of fireplace inserts has to be a standardized mass-production, the construction of fireplace inserts must, however, be such that the use of any form of framework and building-in must be possible; and this has created such problems and difficulties that cast-iron inserts for fireplaces have not been able to be equipped with guided fire-screens and doors; and the purpose of the present invention is therefore to arrive at an improvement of this type for fireplace inserts, which has a door and/or fire-screen of the kind described, without detracting from the building-in and bricking-up possibilities.

In accordance with the invention, this is achieved in that the fireplace insert as a part of the inserts' construction has a room which lies behind the actual fireplace opening, and is shaped in such a way that a door or fire-screen can be inserted into this through a slit-shaped open end which is accessible on the side of the fireplce opening. The room will then lie in the circulation duct for the air which the fireplace heats up; but as the room is closed on all sides, apart from the slit-shaped insertion opening, the smoke from the fireplace which can penetrate into the opening will be held back and prevented from mixing with the circulating air. This is very important if the builtin fireplace is so large that the fire perhaps extends outside the fireplace insert of cast-iron.

It is an advantage to construct the chamber as a closed double cylinder housing and to give the door and/or the fire-screen a cylindrical curvature, so that they fit each other.

Both door and fire-screen can be inserted into the room through the same slit-shaped open end, but as the cylinder-shaped room extends from the one edge of the fireplace opening to the other edge, the room can be open in both the vertical ends for insertion of the door through the opening on one side, and the fire-screen through the opening on the other side.

Figure 1:
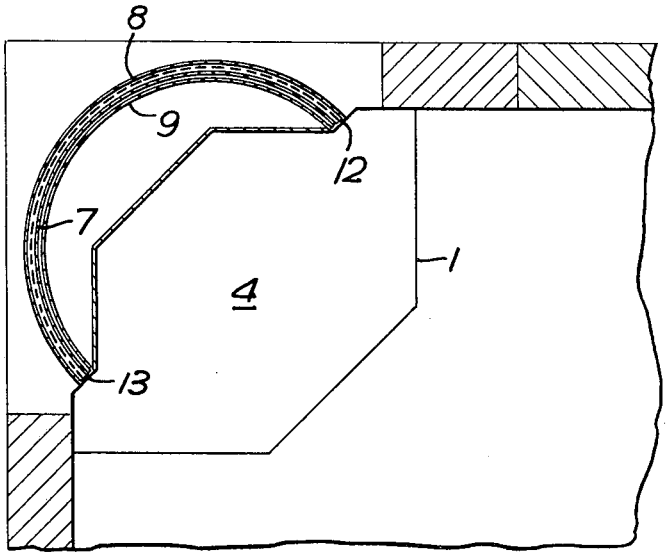
Figure 2:
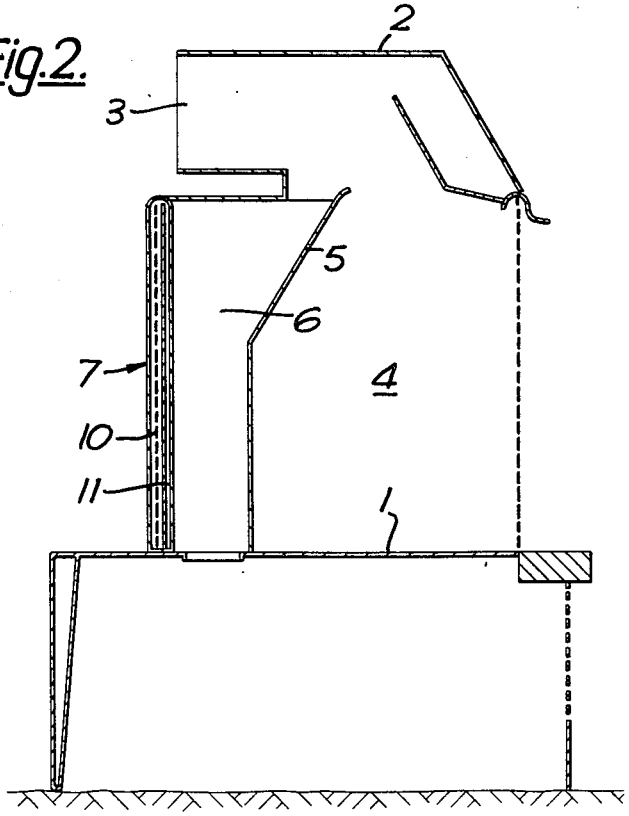

The invention is characterized by the feature quoted in the claims, and will as follows be explained more in detail with reference to the drawing, where FIG. 1 shows a horizontal section through a fireplace, and FIG. 2 shows a vertical section through the same.

The fireplace insert which in the usual way is of cast-iron, is designated by 1. It has a fireplace housing 2, also of usual construction with smoke flue 3. The fireplace itself has a rear wall 5, and usually behind this are to be found ducts 6 for circulation of air which is warmed up by the fireplace insert and is led out into the room where the fireplace stands, in order to best utilize the heat energy in the fire in the fireplace.

In accordance with the invention, behind the actual fireplace insert 1, 4, is room 7 which has sufficient distance between its walls 8 and 9 that there is space between these for a fire-screen 10 which is indicated by a dotted line and a door 11, which is indicated by a continuous line. In the embodiment shown, the room 7 lies in a half circle behind the actual fireplace 4 and its rear wall 5, and said room can be part of the duct 6 for circulation of warm air. The room 7 is meant primarily to be storage space for the fire-screen 10 and the door 11, and these parts can be accommodated in the room in that they also are shaped like a half cylinder surface. In the embodiment shown, the chamber opens out on the sides of the fireplace opening 4 with slit-shaped open ends 12 and 13. As fireplace inserts are often built into larger fireplace constructions one can risk that the fire in the fireplace can be so large that smoke from this can seep in through the slit-shaped open ends 12 and 13, and especially end 12. In order to avoid that smoke from the fire mixes thereby with the air in the room which circulates in duct 6, chamber 7 is closed on all sides with exception of the slit-shaped open ends 12 and 13.

The fire-screen 10 and the door 11 will thereby be invisible when they are not in use, and they can be drawn forward as needed to prevent sparks from flying out on the adjacent floor or to close the fireplace entirely, so that it becomes more similar to a stove, when the fire-screen and door are drawn out respectively.

The example shown serves only to illustrate the invention and forms no limitation for the protection this patent gives, as other embodiments may be thought of which will fall within the protection this patent gives, e.g. the door and the fire-screen can each have their own room and moreover, the room can extend rectilinearly in from their own slit-shaped opening at the edge of the fireplace itself with door and/or fire-screen made as two rectilinear halves.

Having described my invention, I claim:

1. A fireplace insert including a housing defining a fireplace opening, a rear wall opposite said opening, means defining a room behind said rear wall and a vertically extending opening at one end of said room, and a fireplace screen disposed within said room, said screen being movable from a first position substantially wholly disposed within said room and through said room opening to a second position substantially wholly exposed in and substantially wholly closing said fireplace opening, said room being defined by at least one vertically extending wall substantially semi-circular in shape in a longitudinal direction, said fireplace screen lying generally concentrically with the latter wall, said screen in its first position lying substantially wholly behind said rear wall, said rear wall and said one wall being longitudinally spaced one from the other and defining an air duct in said insert for circulation of air.

2. Fireplace construction according to claim 1 wherein said room has a second vertically extending opening at its opposite end, a fireplace door disposed within said room and movable from a first position substantially wholly disposed within said room through said second room opening to a second position substantially closing said fireplace opening.

3. Fireplace construction according to claim 1 wherein said room is defined by a second substantially vertically extending wall substantially semi-circular in shape in a longitudinal direction and concentric with and spaced from said one wall, said first and second walls being coterminus in longitudinal extent and defining a substantially semi-circular chamber therebetween, said fireplace screen being disposed in said chamber between said first and second walls and being coterminus therewith, said fireplace screen in its second position extending between the opposite ends of said room whereby said chamber and said fireplace screen form substantially a complete circle.

4. Fireplace construction according to claim 1 wherein said housing carries a guide defining the upper surface of said fireplace opening, said fireplace screen having an upper surface engageable along said guide when said screen lies in its second position, whereby said screen substantially wholly closes said fireplace opening.

5. Fireplace construction according to claim 1 wherein said insert includes ductwork defining a smoke flue, said flue, said ductwork and said room being formed as integral elements of said insert.

6. Fireplace construction according to claim 1 wherein said room is defined by a second substantially vertically extending wall substantially semi-circular in shape in a longitudinal direction and concentric with said one wall, said first and second walls being coterminus in longitudinal extent and defining a substantially semi-circular chamber therebetween, said fireplace screen being disposed in said chamber between said first and second walls and being coterminus therewith, said fireplace screen in its second position extending between the opposite ends of said room whereby said chamber and said fireplace screen form substantially a complete circle, said housing carrying a guide defining the upper surface of said fireplace opening, said fireplace having an upper surface engageable along said guide when said screen lies in its second position, whereby said screen substantially wholly closes said fireplace opening, said insert including ductwork defining a smoke flue, said flue, said ductwork and said room being formed as integral elements of said insert.

* * * * *